United States Patent [19]

Weber et al.

[11] Patent Number: 4,518,285

[45] Date of Patent: May 21, 1985

[54] CONTROL SYSTEM FOR LONGWALL MINING ROOF SUPPORTS

[75] Inventors: Karl-Heinz Weber, Witten-Heven; Wolfgang Beckmann, Marl; Hartmut Gebaüer, Bottrop, all of Fed. Rep. of Germany

[73] Assignee: Gebr. Eickhoff Maschinenfabrik und Eisengiesserei mbH, Bochum, Fed. Rep. of Germany

[21] Appl. No.: 470,050

[22] Filed: Feb. 28, 1983

[30] Foreign Application Priority Data

Mar. 3, 1982 [DE] Fed. Rep. of Germany ..... 3207517

[51] Int. Cl.[3] ..... E21D 23/12; E21D 23/16; F16B 13/00

[52] U.S. Cl. ..... 405/302; 91/170 MP; 91/527; 299/33

[58] Field of Search ..... 405/291, 292, 299-302; 299/1, 31, 33; 91/170 MP, 427, 460, 461, 527, 531

[56] References Cited

U.S. PATENT DOCUMENTS

| | | | |
|---|---|---|---|
| 3,285,015 | 11/1966 | Carnegie et al. | 405/302 OR |
| 3,531,159 | 9/1970 | Schmidt | 405/302 X |
| 3,664,138 | 5/1972 | Cooper | 405/302 OR |
| 4,050,256 | 9/1977 | Phillips et al. | 405/299 OR |
| 4,109,472 | 8/1978 | Harris | 405/302 OR |
| 4,134,270 | 1/1979 | Small et al. | 405/302 OR |
| 4,159,671 | 7/1979 | Allen | 405/302 X |
| 4,330,154 | 5/1982 | Harris | 405/302 X |
| 4,398,851 | 8/1983 | Geuns et al. | 405/302 OR |
| 4,451,181 | 5/1984 | Trumper et al. | 405/302 OR |

FOREIGN PATENT DOCUMENTS 1121541 7/1968 United Kingdom .

*Primary Examiner*—Dennis L. Taylor
*Assistant Examiner*—Nancy J. Stodola
*Attorney, Agent, or Firm*—Thomas H. Murray

[57] ABSTRACT

A control system for longwall mining roof supports which are controlled in dependence on the position of the mining machine at any time. All of the roof supports are connected to a central computer via common conductors. Each of the roof supports includes a control unit having a code corresponding to the number of that support. This code serves as an address and enables the central computer to transmit its control command signals positively, in response to the mining machine position signals, through an appropriate address control unit for a particular roof support. In order to enable roof supports to be actuated manually also, the control units of all of the roof supports are connected to the central computer by two common conductors, one of which carries an automatic enable signal and the other of which carries a manual enable signal. The system is such that whenever automatic command signals are being transmitted by the computer, manual control cannot be effected; and when manual control signals are being employed, automatic control cannot be effected.

4 Claims, 4 Drawing Figures

CONTROL SYSTEM FOR LONGWALL MINING ROOF SUPPORTS

BACKGROUND OF THE INVENTION

In a longwall mining installation, coal is removed across a face area by a longwall mining machine having forward and aft cutters. As coal is mined and removed, it is deposited onto a conveyor which extends along the longwall face. Hydraulically-powered, self-advancing roof supports or chocks protect equipment and personnel in the working area. As mining advances and the supports are moved forward, the roof behind the supports caves.

A large number of side-by-side roof supports is spaced along the face being mined. Each support comprises a base, a canopy which engages the mine roof, and generally vertical hydraulic cylinders which extend between the base and the canopy and are extended between the base and canopy to exert pressure on the mine roof and prevent it from collapsing. After the longwall mining machine has passed along the face, the upward pressure on the canopy of each support is released. Thereafter, generally horizontal hydraulic cylinders on the individual roof supports or chocks push the face conveyor forward and then pull themselves up into place over it by means of the same cylinders. At this point, upward pressure on the canopy is again exerted to hold the mine roof in place; while the roof behind the advanced support is permitted to fall.

In the past, it has been common to manually control each individual roof support along the face being mined by means of valves. However, some systems have been devised which employ a remote control process wherein the individual roof supports are connected to and controlled by a central dispatcher control system. Each individual roof support is provided with an individual address or identifying signal which is sent from the dispatcher control system. Each support, in turn, is able to detect its identifying signal or address whereby control signals for achieving certain desired control functions can be effected at any individual support. For example, addressing can be achieved by pulse transmission at different frequencies and by signal selection by filters associated with a particular support, whereby direct connection of the individual roof supports to the dispatcher control can be achieved via an electrical multi-conductor installation. Direct connection, however, requires a very large number of individual conductors.

Remote and automatic control of individual roof supports for a longwall mining installation have been provided in which face support control is effected by means of a microprocessor system, using the position of the longwall machine to control individual roof supports ahead of and behind the path of travel of the mining machine. In a system of this type utilizing a microprocessor, pulses proportional in number to the distance covered by the longwall mining machine are transmitted to a central control panel disposed in the roadway or at the end of the face. In this manner, the position of the mining machine along the face can be determined and control of roof supports ahead of and behind the mining machine effected. In one particular microprocessor control system of this type, a 16-bit data word is transmitted serially from a central control panel to control units on all of the individual roof supports. Contained in the data word is an identification of the roof support which is to be actuated and the specific control functions to be accomplished such as advancing the conveyor toward the face, lowering the roof support, pulling the lowered roof support toward the conveyor, and so on. In each control unit for the separate roof supports, means are included for comparing a transmitted identification of a particular roof support from the central panel to stored data in the individual control unit for that support; and if the two are the same, the control unit for an individual support transmits the received control information back to the central control panel for confirmation before a control command is executed and sent back to the individual roof support.

If individual roof supports are to be controlled manually as well as automatically from a central control panel, difficulties arise with the prior art methods of automatically controlling the roof supports from such a central control panel. Manual operation is necessary in the event of malfunctioning occurring at any particular roof support outside the immediate vicinity of the mining machine while mining operations continue. That is, it must be possible to check the functioning of the hydraulic cylinders of a roof support or to check the sequence of movement produced by the cylinders of a malfunctioning support and carry out any necessary repairs without interfering with the automatic control of the remaining roof supports.

SUMMARY OF THE INVENTION

In accordance with the present invention, an automatic computer-controlled system is provided for the individual roof supports of a longwall mining installation, which enables each of the roof supports to be controlled manually so that malfunctions of any individual roof support can be effected without interrupting the automatic control of the remaining roof supports.

The above and other objects and features of the invention will become apparent from the following detailed description taken in connection with the accompanying drawings which form a part of this specification, and in which.

Figure 1:
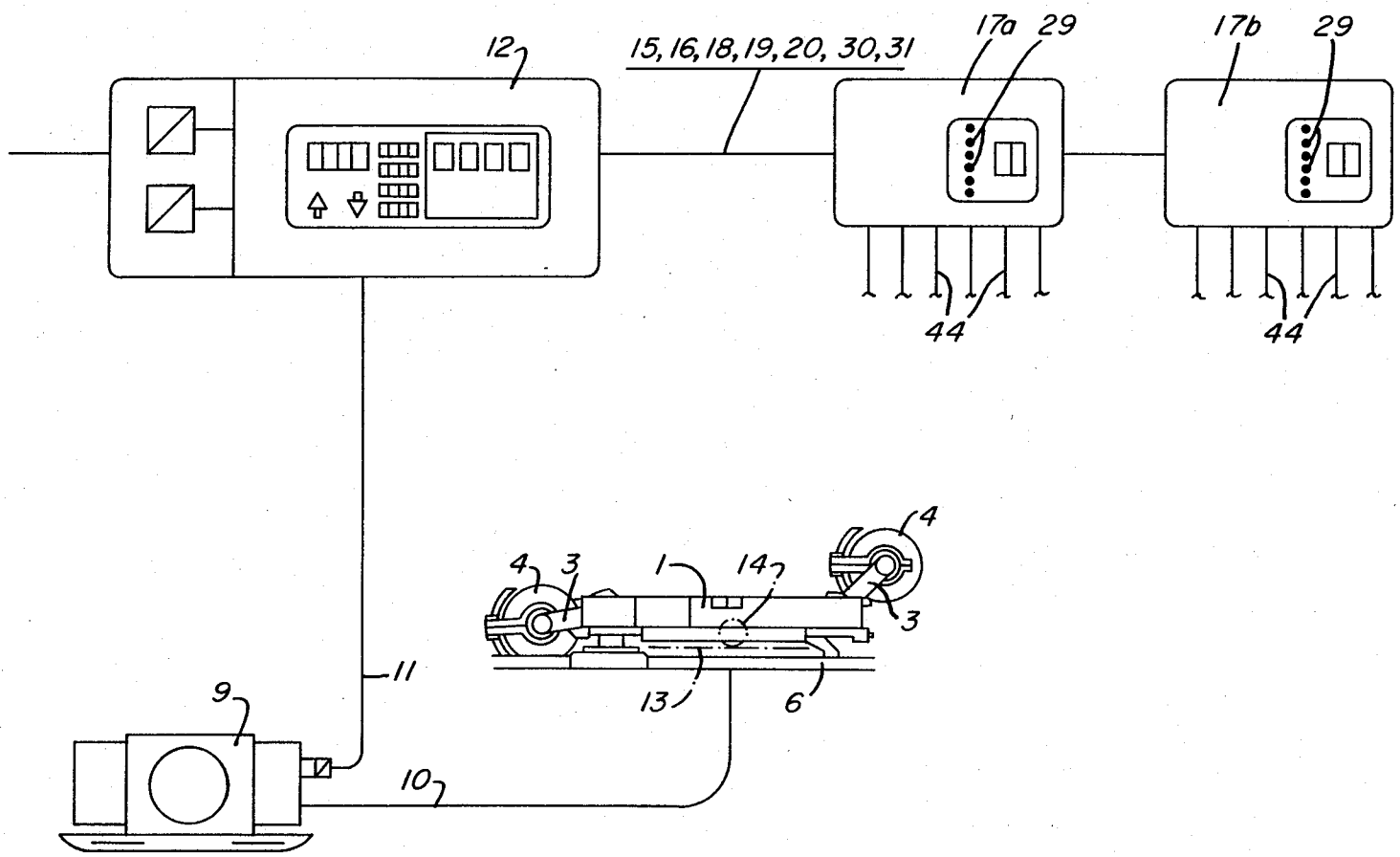
FIG. 1 is a schematic diagram of a longwall mining installation utilizing the control system of the present invention.
Figure 2:
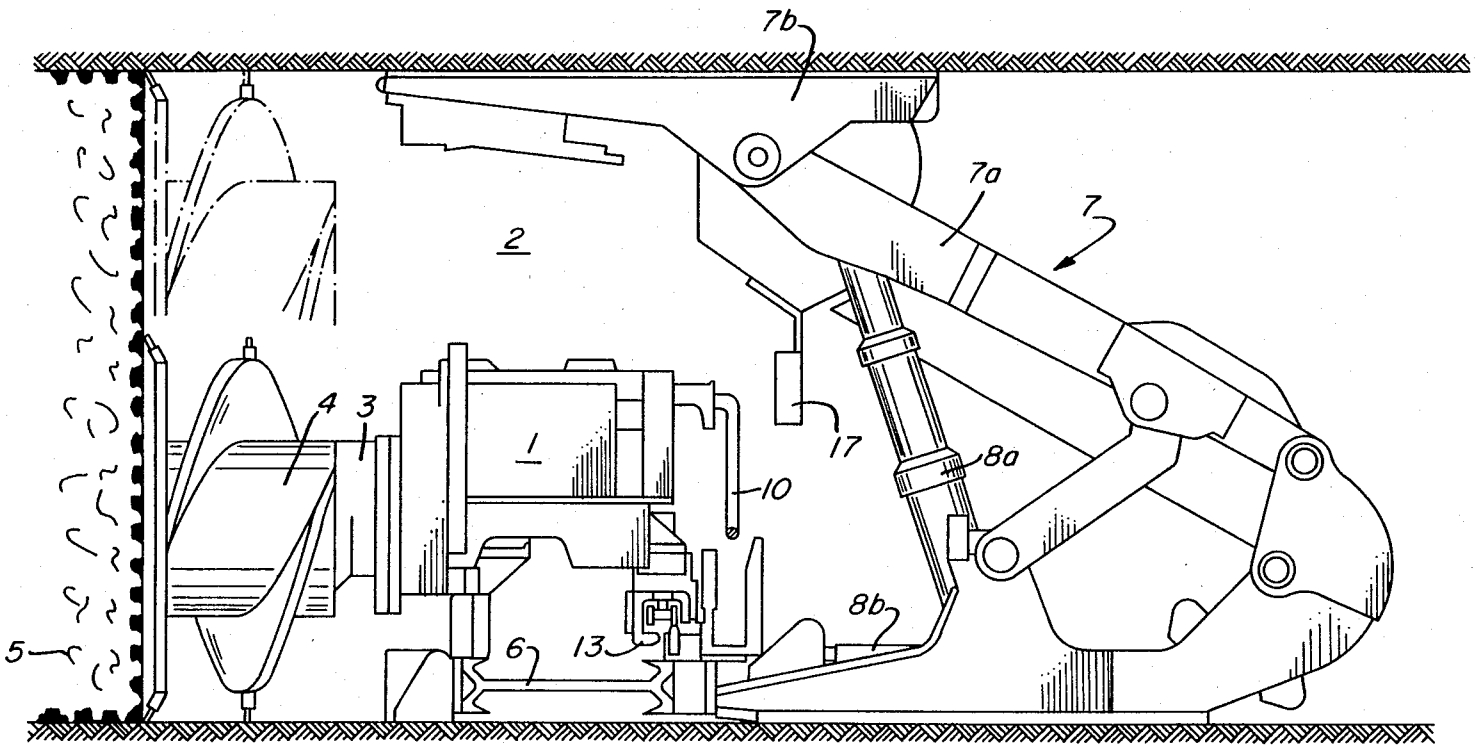
FIG. 2 is a cross-sectional view illustrating the end of a longwall mining machine together with a side view of a typical roof support or chock to be controlled in accordance with the invention.

With reference now to the drawings, and particularly to FIGS. 1 and 2, a longwall mining machine is designated generally by the reference numeral 1 and traverses the entire face area 2 of a longwall mining installation. The mining machine 1 has at its ends pivotal arms 3 which, in turn, carry cutter drums 4 which rotate to mine and remove material. In the illustration given in FIG. 1, it will be assumed that the mining machine 1 moves to the right and that the forward cutter drum 4 removes the upper part of a coal seam; while the trailing drum 4 removes the lower part of the same seam. When the face area is completely traversed, the positions of the two drums are reversed, as is the direction of the machine 1. In FIG. 2, the seam being cut is identified generally by the reference numeral 5.

The mining machine 1 moves along a face conveyor 6 situated beneath a hydraulically-operated roof support system 7 which consists of a plurality of side-by-side individual roof supports or chocks, only one of said roof supports being shown in FIG. 2 and identified by the reference numeral *7a*. It will be appreciated, of course, that a number of such chocks extends along the face area 2 into and out of the plane of the drawing. Each individual roof support *7a* is provided with vertical cylinders *8a* for raising or lowering an upper support plate *7b* and a horizontal cylinder *8b* used to advance the conveyor 6 as well as the individual roof supports *7a* themselves.

Briefly, in the operation of the system, the mining machine 1 is advanced along the conveyor 6 while it removes a cut from the seam 5. As it advances, individual conveyor sections 6 are pushed toward the face area of seam 5 by actuating horizontal hydraulic cylinders *8b*, thereby pushing the conveyor 6 to the left as viewed in FIG. 2. During this time, cylinder *8a* is actuated to securely hold the upper support plate *7b* against the roof of the mine such that the support *7a* itself cannot move. In order to advance the support *7a* to the left after the conveyor 6 has been moved to the left, cylinder *8a* is actuated to slightly lower the upper support *7b* and the cylinder *8b* is then pressurized to pull the entire support *7a* to the left until it is again in essential abutment with the conveyor 6. This permits the roof behind the support *7a* to collapse. Once the support *7a* is pulled to the left as described above, the cylinder *8a* is pressurized in the opposite sense to again push the plate *7b* against the roof to support the same.

Reverting again to FIG. 1, an electrical distribution unit 9 disposed in the mine roadway supplies to the mining machine 1 via cable 10 the electrical energy required for operation of the machine. The mining machine 1 is moved along the conveyor 6 by means of a toothed drive wheel 14 which engages a rack 13 carried above the conveyor 6. As the toothed wheel 14 rotates to advance the mining machine in one direction or the other, an electrical pulse generator, not shown, produces pulses which are fed via power cable 10 and conductor 11 to a central control panel 12 which contains a computer. The number of pulses produced by the pulse generator will, therefore, indicate the position of the mining machine along the conveyor 6. These pulses are electrically added, optically displayed and utilized in the central control panel 12 and utilized as an address for positive control of the individual roof supports *7a*.

Each of the individual roof supports *7a* is provided with a control panel 17 (FIG. 2), two of said control panels for adjacent roof supports being shown in FIG. 1 and identified by the reference numerals *17a* and *17b*. As shown in FIG. 1, each of the individual control units 17 is connected to the others and with the central control unit 12 by means of conductors 15, 16, 18, 19, 20, 30 and 31. As will be seen, each of the control units *17a*, *17b*, etc. for the respective roof supports *7a* is provided with means for receiving and responding to only those signals from the computer in central control panel 12 which identifies that particular roof support. In this respect, it will be appreciated that the address formed by the pulses fed to the computer via conductor 11 will match only the address of the roof support temporarily adjacent the mining machine 1 at any time. In this manner, the computer can determine which roof supports are ahead of the advancing mining machine, which supports are behind it, and can formulate suitable control signals for actuating a selected one or ones of the roof supports.

The control functions for the individual roof supports are transmitted serially to all of the control units *17a*, *17b*, etc. via conductor 18 by means of a 16-bit data word. This data word, in addition to the control command, also contains the address of whichever roof support is to be actuated. The data word is checked and evaluated by the control unit 17 receiving it. In confirmation, the control unit 17 first transmits the control information back to the central control panel 12 via conductor 19. The computer within the central control panel 12, in turn, checks the received information with the transmitted information and, only when they are the same, transmits over another conductor 20 an acceptance signal which alone initiates the control operation in the associated control units *17a*, *17b*, etc.

Figure 3:
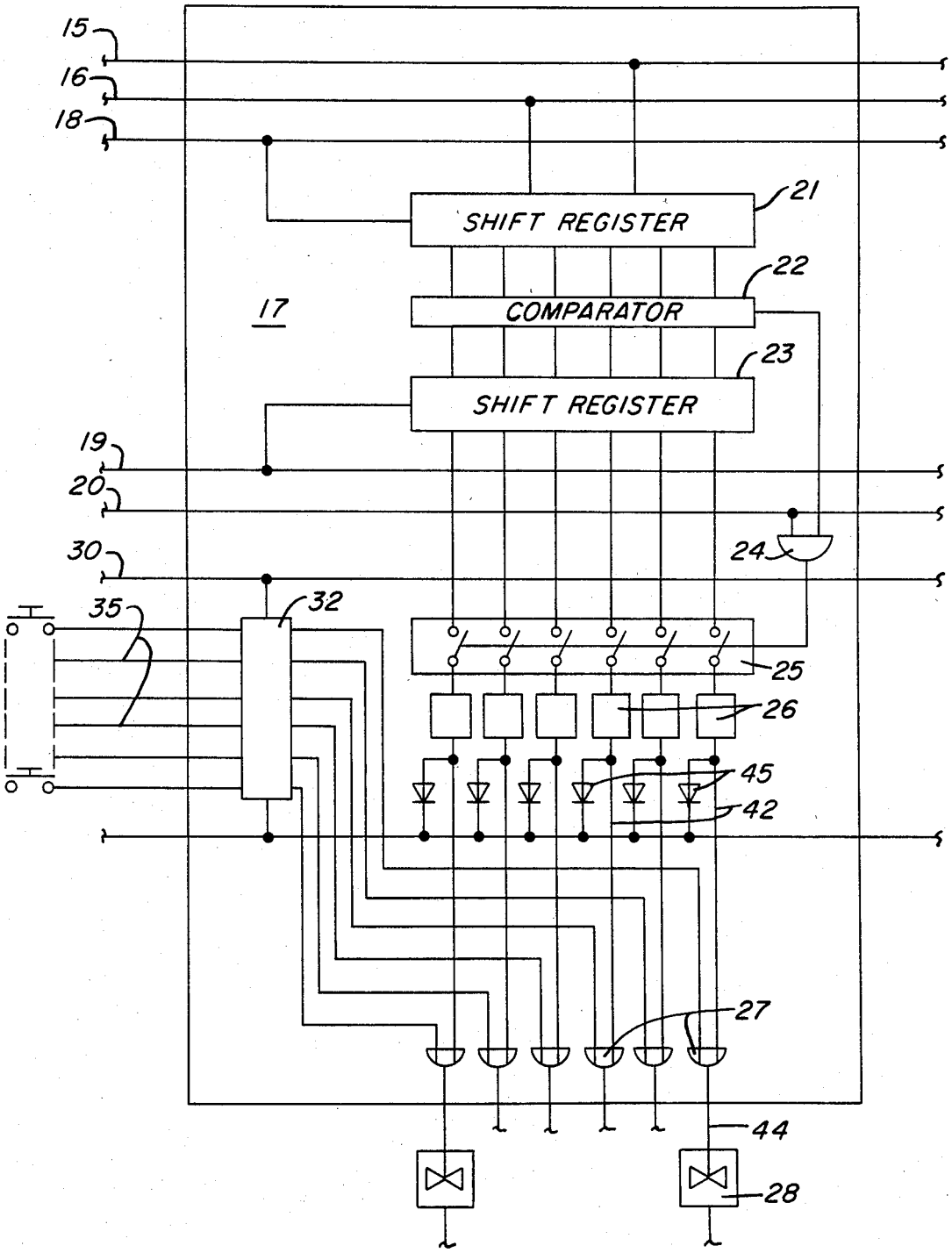
FIG. 3 is a schematic circuit diagram of the control unit for each individual roof support utilized in the invention.

The details of each control units *17a*, *17b*, etc. are shown in FIG. 3. An intrinsically-safe operating voltage is supplied to each control unit 17, as well as the central control unit 12, by means of conductors 15 and 16. As was explained above, the computer control commands are transmitted to all of the individual control units *17a*, *17b*, etc. via control conductor 18. Here they are applied to a shift register 21 which produces a plurality of output bits. These are compared in comparator 22 with bits which identify that particular control unit or individual roof support. Assuming that the received control command identifying a particular control unit 17 matches that stored in the comparator 22, a shift register 23 is actuated to transmit back to the central control unit 12 via conductor 19 a serial digital signal which is identical to that transmitted by the computer on conductor 18. Assuming that the received digital signal matches the original transmitted signal, an enable signal is produced on the conductor 20 which is applied to AND circuit 24 in each of the individual control units 17. However, before the AND circuit 24 will be actuated to close relay contacts 25, a pulse must also be received by the AND circuit from comparator 22 in response to identification of the code for the particular control unit involved. In this manner, only one control unit will be actuated at any one time, notwithstanding the fact that the signal on lead 20 is supplied to all of the control units.

Once the relay contacts 25 have been closed, the signal or signals at the output of shift register 23 are applied to pulse generators 26; however, not all of the pulse generators 26 will be actuated. Rather, only those will be actuated which are to form pulses for performing a function implementing the command. The pulses at the outputs of pulse generator 26 are then applied to OR circuits 27, the outputs of the OR circuits being applied through conductors 44 to pulse-actuated valves 28. Thus, pulses in the pre-programmed time sequence are applied to the respective valves 28 to effect actuation of the cylinders *8a* and *8b* shown in FIG. 2. The valves 28 are pulse-actuated valves. That is, in response to a pulse, they will assume one position and remain in that position until a second pulse is received, whereupon the valve is reversed. A limit switch, not shown, associated with each of the hydraulic cylinders *8a* and *8b* indicates the end of the stroke of that cylinder and is connected to the computer of the central control panel 12 via a conductor, not shown, and causes the computer to deliver a break pulse which returns the pulse-actuated valve to its initial position.

As was mentioned above, it is also necessary to control each of the individual roof supports 7*a* manually. The commands required for this purpose are initiated for each roof support 7*a* via pushbuttons 17*b* provided on each of the control units 17. This manual control must occur without interfering with the automatically-progressing control operation. To this end, another two conductors 30 and 31 are connected to each of the individual control units 17 as well as the central control unit 12. Conductor 30 is adapted to transmit an enable signal for manual commands and conductor 31 an enable signal for automatic commands to all roof supports simultaneously. As shown in FIG. 1, light-emitting diodes 29 on the individual control units 17 display the state to which the individual roof supports have been set at any time and also indicate malfunctioning such as, for example, failure to implement a control command.

Figure 4:
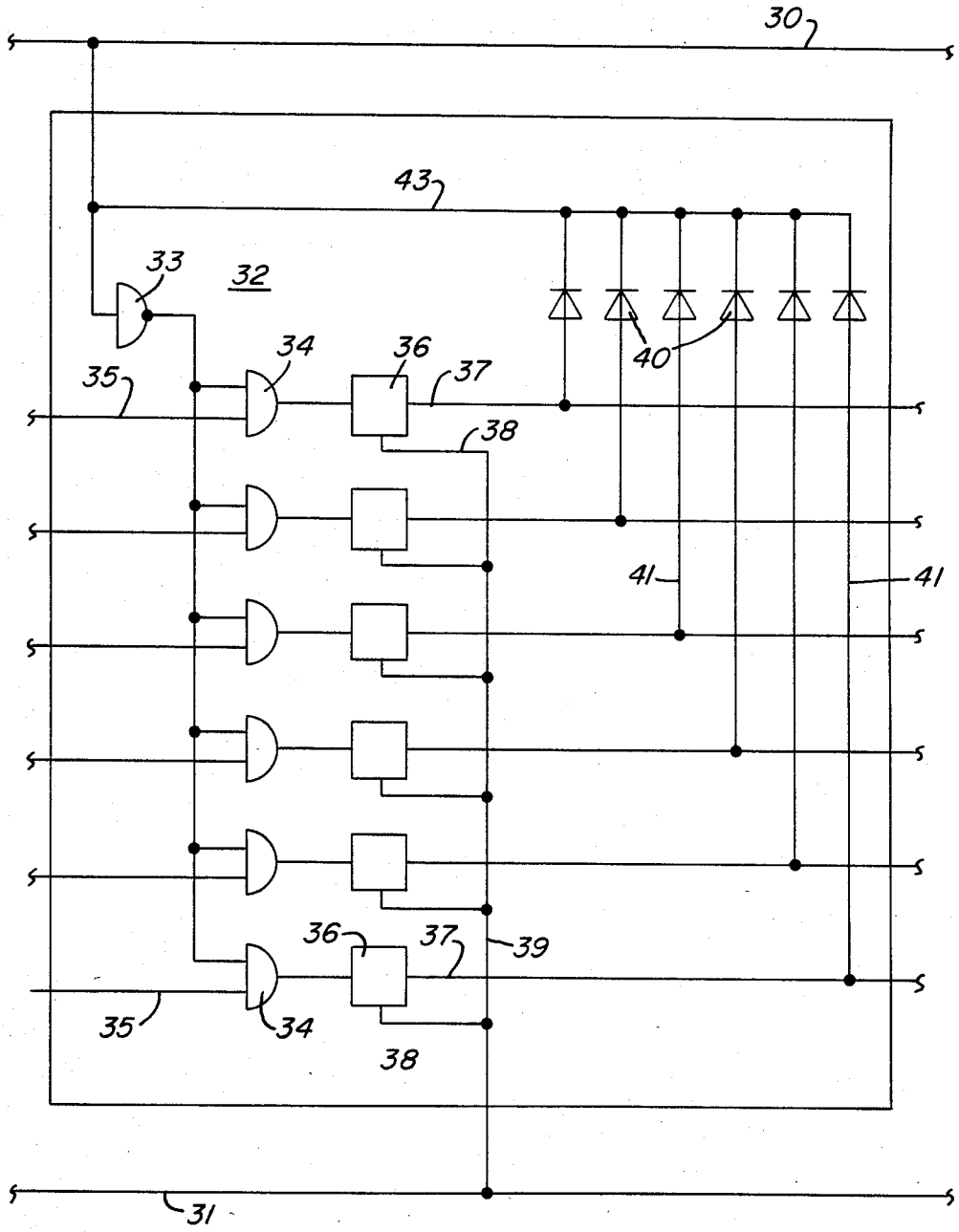
FIG. 4 a schematic circuit diagram of the portion of the control system of FIG. 3 which effects manual commands for any individual roof support.

The manual control circuitry 32 of FIG. 3 is shown in detail in FIG. 4. As can be seen from FIG. 4, the conductor 30 which carries the enable signal for manual commands is connected via inverter 33 to one of two inputs of each of a plurality of AND gates 34, the number of these AND gates corresponding to the number of hydraulic cylinders in an associated roof support 7*a*. The other input 35 to each of the AND gates 34 is connected to each of the pushbuttons 17*a* of the control unit 17 for a roof support. Each of the AND gates 34, in turn, is connected at its output to a pulse network 36, the outputs of the pulse networks being connected via leads 37 to the inputs of the OR networks 27. Thus, actuation of a pushbutton at any roof support location can actuate a corresponding control valve 28 to effect a particular control function for a cylinder 8.

Each of the pulse networks 36 is also connected via lead 39 to the conductor 31 which transmits the enable signal for automatic commands. Whenever an automatic enable signal is present on conductor 31, circuits 36 are disabled such that it is not possible to manually actuate individual roof supports during the period of this control pulse The outputs of the circuits 36 are all connected through leads 41 and diodes 40 to the input of inverter 33. A similar connection is provided between the output leads from the time networks 26 in FIG. 3 and the automatic enable conductor 31 via diodes 45. In this manner, whenever an automatic control function is being accomplished, a signal appears on conductor 31, regardless of the signal from central control unit 12, which disables the manual control of the individual roof supports. The diodes 40, on the other hand, act to insure that once a manual control function is being effected, it will continue to be effected as long as a signal persists at the output of a circuit 36.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a control system for longwall mining roof supports wherein the supports are controlled by a computer in dependence on the position of a longwall mining machine at any time, the computer being connected to individual control units for the roof supports through common electrical conductors, and wherein each control unit is provided with manual control pushbuttons and associated control circuitry for controlling the roof support independently of command signals received from said computer, the improvement in said control system comprising:

a pair of electrical conductors connecting said computer to all of said control units, means in said computer for generating on one of said conductors an automatic enable signal and for generating on the other of said conductors a manual enable signal, and means in each of said control units responsive to said enable signals for preventing manual actuation of a roof support when automatic command signals are being transmitted from said computer and for preventing automatic actuation of a roof support when manual control is being effected

2. The control system of claim 1 wherein each of said control units includes a control section connected to said pair of conductors, each of said control sections including a number of AND gates having one input connected to one of a plurality of manual control pushbuttons and another input operatively connected to said conductor which carries said manual enable signal.

3. The control system of claim 1 wherein the outputs of said AND circuits are each connected to a pulse generator, and means connecting each of said pulse generators to said conductor which carries said automatic enable signal whereby the pulse generators are disabled whenever an automatic enable signal exists.

4. The control system of claim 1 wherein each of said roof supports includes hydraulic cylinders controlled by means of pulse-actuated valves, and wherein said pulse-actuated valves are controlled by signals from an associated roof support control unit.

* * * * *